US008752677B2

(12) United States Patent
Harkonen et al.

(10) Patent No.: US 8,752,677 B2
(45) Date of Patent: Jun. 17, 2014

(54) ELEVATOR SYSTEM INCLUDING MONITORING ARRANGEMENT TO ACTIVATE EMERGENCY BRAKING PROCEDURE BASED ON DECELERATION AND METHOD OF OPERATING THE SAME

(75) Inventors: Ari Harkonen, Riihimaki (FI); Petteri Valjus, Helsinki (FI)

(73) Assignee: Kone Corporation, Helsinki (FI)

( * ) Notice: Subject to any disclaimer, the term of this patent is extended or adjusted under 35 U.S.C. 154(b) by 23 days.

(21) Appl. No.: 13/536,657

(22) Filed: Jun. 28, 2012

(65) Prior Publication Data

US 2012/0267200 A1 Oct. 25, 2012

Related U.S. Application Data

(63) Continuation of application No. PCT/FI2011/000003, filed on Jan. 18, 2011.

(30) Foreign Application Priority Data

Jan. 18, 2010 (FI) ..... 20105033

(51) Int. Cl.
*B66B 1/34* (2006.01)

(52) U.S. Cl.
USPC ..... 187/391; 187/288

(58) Field of Classification Search
USPC ..... 187/247, 277, 287, 288, 291–293, 296, 187/297, 351, 391–393
See application file for complete search history.

(56) References Cited

U.S. PATENT DOCUMENTS

| | | | | |
|---|---|---|---|---|
| 5,869,794 | A * | 2/1999 | Spiess | 187/287 |
| 7,228,943 | B2 * | 6/2007 | Kugiya et al. | 187/393 |
| 7,448,472 | B2 * | 11/2008 | Kugiya et al. | 187/305 |
| 7,533,763 | B2 * | 5/2009 | Kattainen et al. | 187/394 |
| 7,669,697 | B2 * | 3/2010 | Ueda et al. | 187/391 |
| 7,735,610 | B2 * | 6/2010 | Huard et al. | 187/288 |
| 7,740,110 | B2 * | 6/2010 | Kattainen et al. | 187/288 |
| 7,891,466 | B2 * | 2/2011 | Okamoto et al. | 187/288 |
| 7,918,320 | B2 * | 4/2011 | Kondo et al. | 187/288 |
| 8,167,094 | B2 * | 5/2012 | Ueda et al. | 187/288 |
| 8,230,977 | B2 * | 7/2012 | Thumm et al. | 187/247 |
| 2009/0178889 | A1 * | 7/2009 | Harkonen et al. | 187/373 |
| 2009/0288920 | A1 | 11/2009 | Kattainen et al. | |

FOREIGN PATENT DOCUMENTS

| | | | |
|---|---|---|---|
| EP | 1997766 | A1 | 12/2008 |
| FI | 20070148 | A | 8/2008 |
| JP | 2006315823 | A | 11/2006 |
| JP | 2009215047 | A | 9/2009 |
| WO | WO-2008102051 | A1 | 8/2008 |

OTHER PUBLICATIONS

International Search Report and Written Opinion.

* cited by examiner

*Primary Examiner* — Anthony Salata
(74) *Attorney, Agent, or Firm* — Harness, Dickey & Pierce, P.L.C.

(57) ABSTRACT

The invention relates to an elevator system and also to a method for monitoring the movement an elevator car. In the method a first emergency braking procedure is activated for braking the elevator car at a first deceleration if the speed of the elevator car exceeds the first limit value for permitted speed, and also a second emergency braking procedure is further activated for braking the elevator car at a second deceleration that is greater than the first, if the speed of the elevator car exceeds the second limit value for permitted speed that is greater than the first limit value for permitted speed.

19 Claims, 3 Drawing Sheets

ELEVATOR SYSTEM INCLUDING MONITORING ARRANGEMENT TO ACTIVATE EMERGENCY BRAKING PROCEDURE BASED ON DECELERATION AND METHOD OF OPERATING THE SAME

CROSS-REFERENCE TO RELATED APPLICATIONS

This is a Continuation of PCT/FI2011/000003 filed on Jan. 18, 2011, which is an International Application claiming priority from FI 20105033 filed on Jan. 18, 2010; the entire contents of each of which are hereby incorporated by reference.

FIELD OF THE INVENTION

The invention relates to the safety of elevators and more particularly to the monitoring of the movement of an elevator car.

BACKGROUND OF THE INVENTION

The electric drive of an elevator attends to the moving of an elevator car in an elevator hoistway between stopping floors. The control system of the elevator forms a target value for the speed of the elevator car, i.e. a speed reference, for the electric drive. The speed reference can be divided into the acceleration phase of a run, the phase of even speed, and also the deceleration phase. The control system of the elevator starts the deceleration phase of a run when the elevator car has arrived at a predefined distance from the stopping floor. Normally the speed of the elevator car decelerates in a controlled manner at the deceleration determined by the speed reference such that the speed of the elevator car decreases to zero when the elevator car arrives at the stopping floor. The aim, especially when the elevator car stops at the terminal floor, is to ensure that the speed of the elevator car decelerates rapidly enough, because otherwise the elevator car or the counterweight is in danger of colliding with the end buffer. It is particularly important to ensure adequate deceleration when using so-called shallow end zones, such as a shallow pit of the elevator hoistway or shallow top clearance in the top part of the elevator hoistway. When using shallow end zones also the length of the end buffers, and therefore the collision damping capability, is usually limited. To ensure deceleration of the elevator car, the speed of an elevator car approaching the terminal floor is measured, and if the speed exceeds a set monitoring limit a mechanical stopping appliance, such as a safety gear, is activated to stop the elevator car. The aforementioned monitoring limit can be determined dependently on location such that the same value for the monitoring limit is always used in the same location and at the same distance from the end of the elevator hoistway.

A passenger in the elevator may find the gripping situation a quite unpleasant experience owing to the significantly greater than normal deceleration of the elevator car during the gripping. When the elevator is driving upwards, if the deceleration of the elevator car were to exceed the acceleration of free fall of the attractive force of the earth's gravity when the elevator is driving upwards, there would be the additional danger that an elevator passenger would rise into the air as a consequence of the gripping situation. Additionally, during an emergency stop of the elevator car the deceleration might vary in different parts of the elevator hoistway owing to, among other things, the effect of the weight of the elevator ropes. Elongation of the elevator ropes, on the other hand, might result in the speed of the elevator car during deceleration being momentarily greater than that permitted even if the speed of the traction sheave of the hoisting machine were to decelerate in the manner specified by the speed reference. Particularly with large travel heights, speed monitoring could activate the safety gear as a result of instantaneous overspeed caused by elongation of the elevator ropes.

SUMMARY OF THE INVENTION

The aim of the invention is therefore to disclose a method for monitoring the movement of an elevator car, and also an elevator system wherein the movement of an elevator car is monitored. According to the invention, the deceleration of the elevator car is increased progressively in connection with an emergency stop of the elevator car by activating separate emergency braking procedures consecutively such that it is endeavored to stop the elevator car with as small a deceleration as possible while, however, simultaneously taking into account the safety of the elevator passengers.

In relation to the characteristic attributes of the invention, reference is made to the claims. Some inventive embodiments and inventive combinations of the various embodiments are also presented in the descriptive section and in the drawings of the present application.

The invention relates to a method for monitoring the movement of an elevator car. In the method a first emergency braking procedure is activated for braking the elevator car at a first deceleration $a_1$ if the speed of the elevator car exceeds the first limit value $v_{lim1}$ for permitted speed, and in the method a second emergency braking procedure is further activated for braking the elevator car at a second deceleration $a_2$ that is greater than the first, if the speed of the elevator car exceeds the second limit value $v_{lim2}$ for permitted speed that is greater than the first limit value $v_{lim1}$ for permitted speed. The aforementioned first deceleration a1 of the elevator car is preferably greater than the normal deceleration of the elevator car according to the deceleration phase of the speed reference vref. According to the basic idea of the invention the deceleration of the elevator car is increased progressively by activating consecutive emergency braking procedures during an emergency stop such that the deceleration of the elevator car achieved by the subsequent emergency braking procedure is always greater than the deceleration of the elevator car achieved by the preceding emergency braking procedure.

In one embodiment of the invention a third emergency braking procedure is further activated for braking the elevator car at a third deceleration $a_3$ that is greater than the second, if the speed of the elevator car exceeds the third limit value $v_{lim3}$ for permitted speed that is greater than the second limit value $v_{lim2}$ for permitted speed.

In a preferred embodiment of the invention, as a first emergency braking procedure, the speed of the elevator car is adjusted towards the target value for speed during an emergency stop by controlling the electric drive of the elevator with a control unit of an emergency stop and, as a second emergency braking procedure, one or more machinery brakes of the hoisting machine of the elevator are activated. The aforementioned target value for speed during an emergency stop is determined such that the target value for speed decreases by the angular coefficient determined by the first deceleration $a_1$ according to the aforementioned first emergency stop procedure of the elevator car. The aforementioned one or more machinery brakes of the hoisting machine of the elevator is/are dimensioned, on the other hand, to exert braking force on the traction sheave of the hoisting machine of the elevator, the second deceleration $a_2$ achieved by which braking force is greater than the first deceleration $a_1$ according to the first emergency stop procedure. In some embodiments of the invention one or more machinery brakes of the hoisting machine are activated consecutively to each other such that first only one machinery brake is activated; after this, if the speed of the elevator car exceeds the set limit value for permitted speed, a second machinery brake is further activated.

In a preferred embodiment of the invention, as a third emergency braking procedure, the safety gear of the elevator car is activated. The safety gear is in this case dimensioned to exert braking force between the elevator car and the guide rail, the third deceleration $a_3$ achieved by which braking force is greater than the second deceleration $a_2$ according to the second emergency stop procedure.

With regard to the second aspect, the invention relates to an elevator system, which comprises an electric drive, for moving an elevator car in an elevator hoistway; a machinery brake; a monitoring arrangement, which monitoring arrangement comprises means for controlling the electric drive and the machinery brake; and which monitoring arrangement is arranged to activate a first emergency braking procedure for braking the elevator car at a first deceleration $a_1$ if the speed of the elevator car exceeds the first limit value $v_{lim1}$ for permitted speed; and which monitoring arrangement is arranged to further activate a second emergency braking procedure for braking the elevator car at a second deceleration $a_2$ that is greater than the first, if the speed of the elevator car exceeds the second limit value $v_{lim2}$ for permitted speed that is greater than the first limit value $v_{lim1}$ for permitted speed. The aforementioned first deceleration a1 is preferably greater than the normal deceleration of the elevator car according to the deceleration phase of the speed reference vref. According to the basic idea of the invention the deceleration of the elevator car is increased progressively by activating consecutive emergency braking procedures during an emergency stop such that the deceleration of the elevator car achieved by the subsequent emergency braking procedure is always greater than the deceleration of the elevator car achieved by the preceding emergency braking procedure. The aforementioned consecutive different emergency braking procedures are preferably independent of each other such that braking apparatuses separate to each other are used in the different emergency braking procedures. The progressive increase in deceleration in connection with the first and the second emergency braking procedure can be e.g. approx. ten percent of the normal deceleration of the elevator.

The monitoring arrangement according to the invention preferably comprises a control unit of an emergency stop. In a preferred embodiment of the invention the control unit of an emergency stop is, as a first emergency braking procedure, arranged to adjust the speed of the elevator car with the electric drive towards the target value for speed during an emergency stop. The control unit of an emergency stop is preferably fitted into the control system of the elevator such that the calculation performed by the control unit of an emergency stop, said calculation being of the target value for the speed of the elevator car during an emergency stop, is independent of any other calculation of the speed reference of the elevator. The aforementioned target value for speed during an emergency stop is determined such that the target value for speed decreases by the angular coefficient determined by the first deceleration $a_1$ according to the aforementioned first emergency stop procedure of the elevator car.

In a preferred embodiment of the invention the monitoring arrangement is, as a second emergency braking procedure, arranged to activate one or more machinery brakes for braking the elevator car at a second deceleration $a_2$ that is greater than the first. The aforementioned one or more machinery brakes is/are dimensioned to exert braking force on the traction sheave of the hoisting machine of the elevator, the second deceleration $a_2$ achieved by which braking force is greater than the first deceleration $a_1$ according to the first emergency stop procedure.

In a preferred embodiment of the invention the elevator system comprises a safety gear; and the monitoring arrangement comprises means for controlling the safety gear; and the monitoring arrangement is in this case arranged to further activate the safety gear, as a third emergency braking procedure, for braking the elevator car at a third deceleration $a_3$ that is greater than the second, if the speed of the elevator car exceeds the third limit value $v_{lim3}$ for permitted speed that is greater than the second limit value $v_{lim2}$ for permitted speed. The safety gear is in this case dimensioned to exert braking force between the elevator car and the guide rail, the third deceleration $a_3$ achieved by which braking force is greater than the second deceleration $a_2$ according to the second emergency stop procedure.

Each of the aforementioned limit values $v_{lim1}$, $v_{lim2}$, $v_{lim3}$ for permitted speed of the elevator car depends preferably upon the position of the elevator car on its path of movement such that the limit value $v_{lim1}$, $v_{lim2}$, $v_{lim3}$ for permitted speed, to which the speed of the elevator car is compared, decreases when the position of the elevator car towards the end of the elevator hoistway changes.

In a preferred embodiment of the invention the first limit value $v_{lim1}$ for permitted speed of the elevator car in this case decreases towards the end of the elevator hoistway by a gradient, which gradient depends on the aforementioned first deceleration $a_1$ of the elevator car. The second limit value $v_{lim2}$ for permitted speed of the elevator car, on the other hand, decreases in this case by a gradient, which gradient depends on the aforementioned second deceleration $a_2$ of the elevator car. The first limit value $v_{lim1}$ for permitted speed of the elevator car is in this case determined preferably by means of the first deceleration $a_1$ of the elevator car and also the distance of the elevator car from the terminal floor s, using the equation:

$$v_{lim\,1}=\sqrt{2a_1 s}.$$

The second limit value $v_{lim2}$ for permitted speed of the elevator car is in this case determined preferably by means of the second deceleration $a_2$ of the elevator car, the distance of the elevator car from the end buffer d and also the permitted buffer collision speed $v_{coll}$, using the equation:

$$v_{lim\,2}=\sqrt{2a_2 d+v_{coll}^2}.$$

The third limit value $v_{lim3}$ for permitted speed of the elevator car, on the other hand, in this case preferably decreases by a gradient, which gradient depends on the aforementioned third deceleration $a_3$ of the elevator car. The third limit value $v_{lim3}$ for permitted speed of the elevator car is in this case determined preferably by means of the third deceleration $a_3$ of the elevator car, the distance of the elevator car/counterweight from the end buffer d and also the permitted buffer collision speed $v_{coll}$, using the equation:

$$v_{lim\,3}=\sqrt{2a_3 d+v_{coll}^2}.$$

It must be noted here that above the constant values are used for the first $a_1$, the second $a_2$ and the third $a_3$ deceleration of the elevator car. In practice, however, the deceleration might vary slightly during the braking, e.g. owing to variation in the structure of the braking apparatus, in the braking method and/or in the friction. In this case the first $a_1$, the second $a_2$ and the third $a_3$ deceleration are understood to be the average deceleration during braking The first limit value $v_{lim1}$ for permitted speed of the elevator car presented above approaches the speed reference of the elevator car during the deceleration phase of the speed reference. For this reason, when the elevator car approaches a stopping floor an instantaneous fluctuation in the speed of the elevator car could cause unnecessary activation of the first emergency braking procedure. In order to prevent this the first limit value for speed is often increased in the proximity of the stopping floor, e.g. by adding a defined additional term to the first limit value for speed and/or by increasing the value of the distance of the elevator car from the terminal floor s in the calculation equation of the first limit value for speed presented above such that the stopping point of the elevator is located slightly beyond the terminal floor. The equations of the second and third limit values $v_{lim2}$, $v_{lim3}$ for permitted speed presented above describe the maximum value for which the limit values can be set. Before commissioning, however, the second and third limit values $v_{lim2}$, $v_{lim3}$ for permitted speed can for safety reasons be reduced slightly, which ensures an adequate braking distance irrespective of a possible fluctuation in the deceleration of the elevator car and also irrespective of e.g. activation delays, such as an activation delay of the machinery brake and/or of the safety gear, of the emergency braking procedures.

The aforementioned first $v_{lim1}$, second $v_{lim2}$ and third $v_{lim3}$ limit value for permitted speed preferably do not overlap each other but instead they are determined such that the aforementioned third limit value $v_{lim3}$ for permitted speed is always greater in absolute value than the aforementioned second limit value $v_{lim2}$ for permitted speed, and the aforementioned second limit value $v_{lim2}$ for permitted speed is always greater in absolute value than the aforementioned first limit value $v_{lim1}$ for permitted speed.

In one embodiment of the invention the monitoring arrangement comprises speed monitoring units, which speed monitoring units are disposed in the end zone of the elevator hoistway. Each speed monitoring unit comprises an input for the speed measurement signal of the elevator car. The speed monitoring units are disposed at different points beside the path of movement of the elevator car. The speed monitoring units are connected to the safety circuit of the elevator such that each speed monitoring unit is able, if necessary, to activate the machinery brake. In some embodiments the speed measurement of each speed monitoring unit is duplicated such that each speed monitoring unit comprises an input for the machine encoder that measures the movement of the traction sheave of the hoisting machine and also in addition an input for the encoder that measures the movement of the elevator car and that is to be connected to a guide rail via a rotating roller fitted in connection with the elevator car. In this case the speed monitoring unit is arranged to compare the measuring signals of the different sensors to each other and when it detects that the measuring data deviate from each other by more than what is permitted the speed monitoring unit is arranged to activate an emergency braking procedure.

In a second embodiment of the invention the monitoring arrangement comprises a sensor, which sensor is arranged in connection with the rope pulley of the overspeed governor, for measuring the speed of rotation of the rope pulley. In some embodiments the monitoring arrangement comprises two sensors, both of which are arranged in connection with the rope pulley of the overspeed governor for duplicating the speed measurement. The monitoring arrangement also comprises a speed monitoring unit, which is connected to the aforementioned sensor/sensors. In those embodiments in which the monitoring arrangement comprises two sensors, the speed monitoring unit is arranged to compare the measuring signals of the different sensors to each other and when it detects that the measuring data deviate from each other by more than what is permitted the speed monitoring unit is arranged to activate an emergency braking procedure. The speed monitoring unit is connected to the safety circuit of the elevator, for activating the machinery brake and/or the safety gear. The speed monitoring unit is arranged to activate a second emergency braking procedure for braking the elevator car at a second deceleration if the speed of the elevator car exceeds the second limit value for permitted speed. The speed monitoring unit is arranged to further activate a third emergency braking procedure for braking the elevator car at a third deceleration that is greater than the second, if the speed of the elevator car exceeds the third limit value for permitted speed that is greater than the second limit value for permitted speed.

When determining the aforementioned limit values $v_{lim1}$, $v_{lim2}$, $v_{lim3}$ for permitted speed by means of the acceleration $a_1$, $a_2$, $a_3$ according to each emergency braking procedure in the manner presented above, the emergency braking procedures to be activated consecutively can always be started at the correct moment and in a controlled manner such that the emergency braking procedure to be activated at any given time is able to stop the elevator car safely before the end of the elevator hoistway if the emergency braking apparatus to be used in the emergency braking procedure is operationally viable. The safety of an elevator system also increases as the number of consecutive emergency braking procedures increases. The set limit values $v_{lim1}$, $v_{lim2}$, $v_{lim3}$ for permitted speed correspond essentially to the maximum possible limit values for safe operation. Since the instantaneous speed of the elevator car can vary within the scope of the aforementioned limit values $v_{lim1}$, $v_{lim2}$, $v_{lim3}$ for permitted speed, according to the invention it is thus possible with the set limit values $v_{lim1}$, $v_{lim2}$, $v_{lim3}$ for permitted speed to essentially reduce e.g. emergency stops occurring as a consequence of an instantaneous speed fluctuation/overspeed of the elevator car caused by elongation of the elevator ropes.

In the invention the speed of the elevator car can also be determined e.g. from the measuring signal of an acceleration sensor that is fitted in connection with the elevator car and that moves along with the elevator car. The determination of speed from the measuring signal of the acceleration sensor that moves along with the elevator car is thus advantageous so that in this case no measuring error occurs in the speed data of the elevator car e.g. when the ropes slip on the traction sheave of the hoisting machine of the elevator.

The aforementioned summary, as well as the additional features and advantages of the invention presented below, will be better understood by the aid of the following description of some embodiments, said description not limiting the scope of application of the invention.

MORE DETAILED DESCRIPTION OF PREFERRED EMBODIMENTS OF THE INVENTION

Embodiment 1

Figure 1:
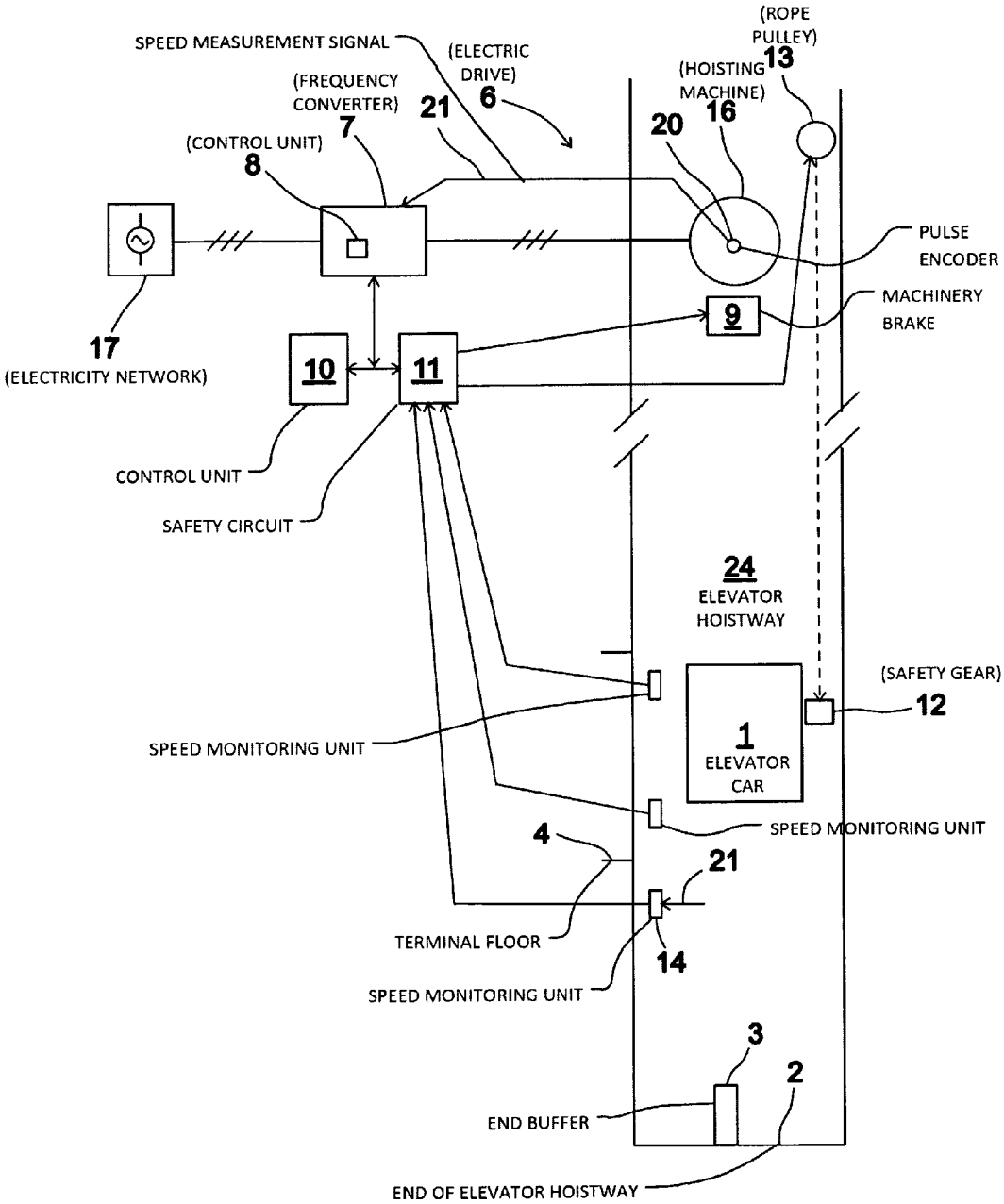
FIG. 1 presents as a block diagram an elevator system according to a first embodiment of the invention

FIG. 1 presents as a block diagram an elevator system according to a first embodiment of the invention, wherein the elevator car 1 is moved in the elevator hoistway 24 with an electric drive 6, which comprises the hoisting machine 16 of the elevator and also a frequency converter 7. The elevator car 1 and the counterweight 18 are suspended in the elevator hoistway 24 with hoisting ropes, a belt or corresponding (not shown in the figure) passing via the traction sheave of the hoisting machine 16 of the elevator. The power supply to the electric motor of the hoisting machine 16 of the elevator occurs with a frequency converter 7 from an electricity network 17. The control unit 10 of the elevator calculates the target value for speed, i.e. the speed reference, of the elevator car 1 to be moved in the elevator hoistway 24 and the frequency converter 7 adjusts the speed of the hoisting machine 16, and thereby indirectly also the speed of the elevator car 1, towards the aforementioned speed reference communicated to the frequency converter 7. For adjusting the speed the frequency converter measures the speed of rotation of the hoisting machine 16 of the elevator with a speed sensor, such as with a pulse encoder 20, a tachometer or corresponding, fitted to the shaft of the hoisting machine 16.

The elevator system also comprises a monitoring arrangement, which is usually made to be at least partly separate from the rest of the control system of the elevator. The task of the monitoring arrangement is to take care of the safety of the elevator system. The monitoring arrangement comprises, in addition to the safety circuit 11 of the elevator, inter alia, monitoring units 8, 14, sensors 20, and braking devices 9, 12. The braking devices, such as a machinery brake 9 and a safety gear 12, are connected to the safety circuit such that the machinery brake 9 and the safety gear 12 can be activated via the safety circuit. The monitoring arrangement measures the operating state of the elevator system and when it detects a hazardous situation performs one or more procedures for bringing the elevator system to a safe state. These procedures are e.g. activation of emergency braking and also prevention of the starting of a run of the elevator car 1.

The sensors incorporated in the safety circuit 11 of the elevator system are e.g. the safety switches (not shown in the figure) monitoring the locking/ state of entrances to the elevator hoistway 24, and also the limit switches (not shown in the figure) monitoring the limits of the areas of permitted movement of the elevator car 1 in the elevator hoistway 24. The speed of the elevator car is measured with sensors 20 that measure the speed of rotation of the hoisting machine 16.

In this embodiment of the invention the monitoring arrangement comprises speed monitoring units 14, which are disposed in the bottom end zone of the elevator hoistway 24. Each of the speed monitoring units 14 comprises an input for the speed measurement signal 21 of the elevator car, which signal is formed here with the encoder 20 of the hoisting machine of the elevator; the speed measurement signal 21 of the elevator car could, however, also be formed with e.g. a sensor that measures the speed of rotation of a rope pulley 13 fitted in connection with the rope pulley 13 of the overspeed governor. The speed monitoring units 14 are disposed at different points beside the path of movement of the elevator car 1. The speed monitoring units 14 are connected to the safety circuit 11 of the elevator such that each of the speed monitoring units is able, if necessary, to activate the machinery brake 9.

Figure 3:
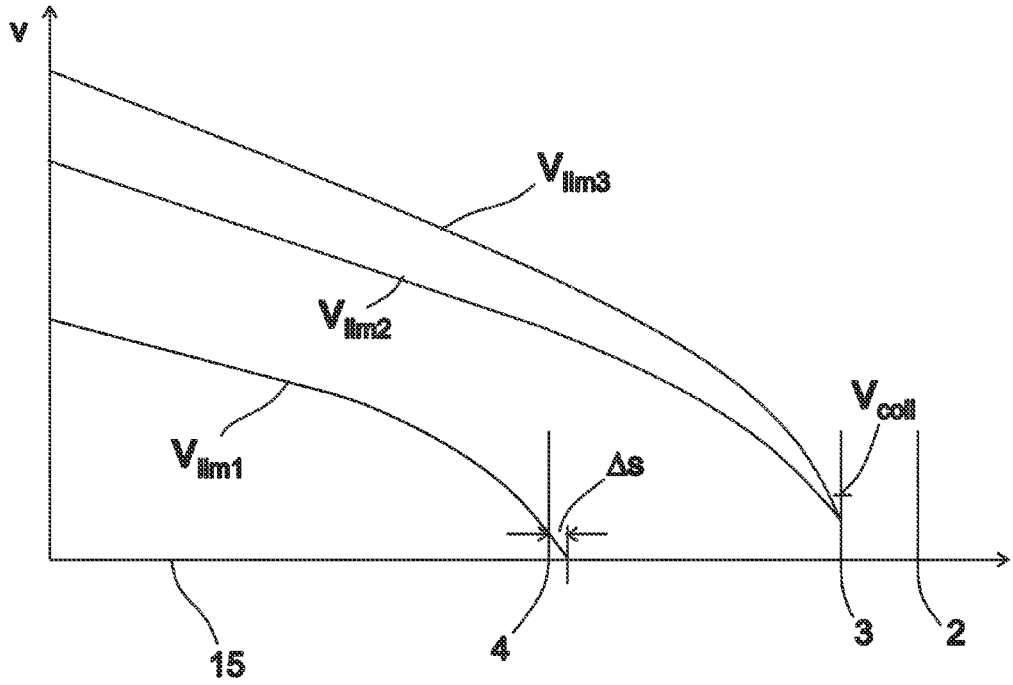
FIG. 3 illustrates some limit values for permitted speed according to the invention, described in relation to the position of the elevator car

The monitoring arrangement measures the speed of the elevator car 1 and compares the measured speed to the limit values for permitted speed. When the speed of the elevator car 1 exceeds the limit value for permitted speed, the monitoring arrangement activates consecutive emergency braking procedures such that the deceleration of the elevator car increases progressively. FIG. 3 illustrates in more detail some limit values $v_{lim1}$, $v_{lim2}$ for permitted speed according to the embodiment of FIG. 1, described in relation to the position 15 of the elevator car in the end zone of the elevator hoistway. Each of the limit values $v_{lim1}$, $v_{lim2}$ for permitted speed of the elevator car depends upon the position 15 of the elevator car on its path of movement such that the limit value $v_{lim1}$, $v_{lim2}$ for permitted speed, to which the speed v of the elevator car 1 is compared, decreases when the position 15 of the elevator car 1 towards the end 2 of the elevator hoistway changes. The control unit 8 of an emergency stop fitted in connection with the frequency converter 7 compares the speed v of the elevator car 1 measured with the encoder 20 of the hoisting machine of the elevator to the first limit value $v_{lim1}$ for permitted speed. If the speed v of the elevator car 1 exceeds the first limit value $v_{lim1}$ for permitted speed, the control unit 8 of an emergency stop activates a first emergency braking procedure. As a first emergency braking procedure the control unit 8 of an emergency stop controls the electric drive 6, adjusting the speed v of the elevator car towards the target value 5 for speed during an emergency stop. The control unit 8 of an emergency stop also calculates the aforementioned target value 5 for speed during an emergency stop such that the target value for speed during an emergency stop is formed independently from the speed reference during normal operation of the elevator calculated by the control unit 10 of the elevator.

The aforementioned first limit value $v_{lim1}$ for permitted speed of an elevator car is determined such that the elevator car can be stopped at a first deceleration $a_1$ at the terminal floor 4, or in the immediate proximity of the terminal floor 4, from the speed v that the elevator car has at the moment of activating the first emergency braking procedure. The first limit value $v_{lim1}$ for permitted speed is determined by means of the first deceleration $a_1$ of the elevator car and also the distance of the elevator car from the terminal floor s from the equation:

$$v_{lim1}=\sqrt{2a_1(s+\Delta s)}.$$

In addition, the first limit value $v_{lim1}$ for permitted speed in the equation above is increased by adding the term Δs to the distance of the elevator car from the terminal floor s. This ensures that the first emergency braking procedure is not activated in the proximity of the stopping floor of the elevator owing to a fluctuation in the instantaneous speed of the elevator car.

The speed monitoring units 14 presented above that are fitted beside the path of movement of the elevator car 1 monitor the speed v of the elevator car 1 arriving at the point of a speed monitoring unit 14. The speed monitoring unit 14 compares the speed data of the speed measurement signal 21 of the elevator car to the second limit value $v_{lim2}$ for permitted speed of the elevator car, which limit value is determined for each speed monitoring unit 14 separately such that the limit values for permitted speed of the different monitoring units 14 are located on the limit value curve for permitted speed of the second limit value $v_{lim2}$, which curve is illustrated in FIG. 3. If the speed v of the elevator car 1 still increases, exceeding the second limit value $v_{lim2}$ for permitted speed that is larger than the aforementioned first limit value $v_{lim1}$ for permitted speed, the speed monitoring unit 14 activates, as a second emergency braking procedure, the machinery brake 9.

The aforementioned second limit value $v_{lim2}$ for permitted speed of the elevator car is determined such that the speed of the elevator car can be slowed down before collision with the end buffer 3 at a second deceleration $a_2$ determined by the machinery brake 9 to the permitted buffer collision speed $v_{coll}$ from the speed v that the elevator car has at the moment of activating the second emergency braking procedure. The second limit value $v_{lim2}$ for speed is determined by means of the second deceleration $a_2$ of the elevator car, the distance of the elevator car from the end buffer d and also the permitted buffer collision speed $v_{coll}$, from the equation:

$$v_{lim\,2}=\sqrt{2a_2d+v_{\mathrm{coll}}^2}-\Delta v_{safety}.$$

In addition, the second limit value $v_{lim2}$ for speed in the equation above is reduced for safety reasons with the term $\Delta v_{safety}$. This ensures an adequate braking distance irrespective of a possible instantaneous fluctuation in the deceleration of the elevator car and also irrespective of e.g. an activation delay of the machinery brake.

The accuracy of the monitoring of the movement of the elevator car can be improved by increasing the number of consecutively disposed speed monitoring units 14 such that the intermediate distance between the speed monitoring units 14 decreases.

Embodiment 2

Figure 2:
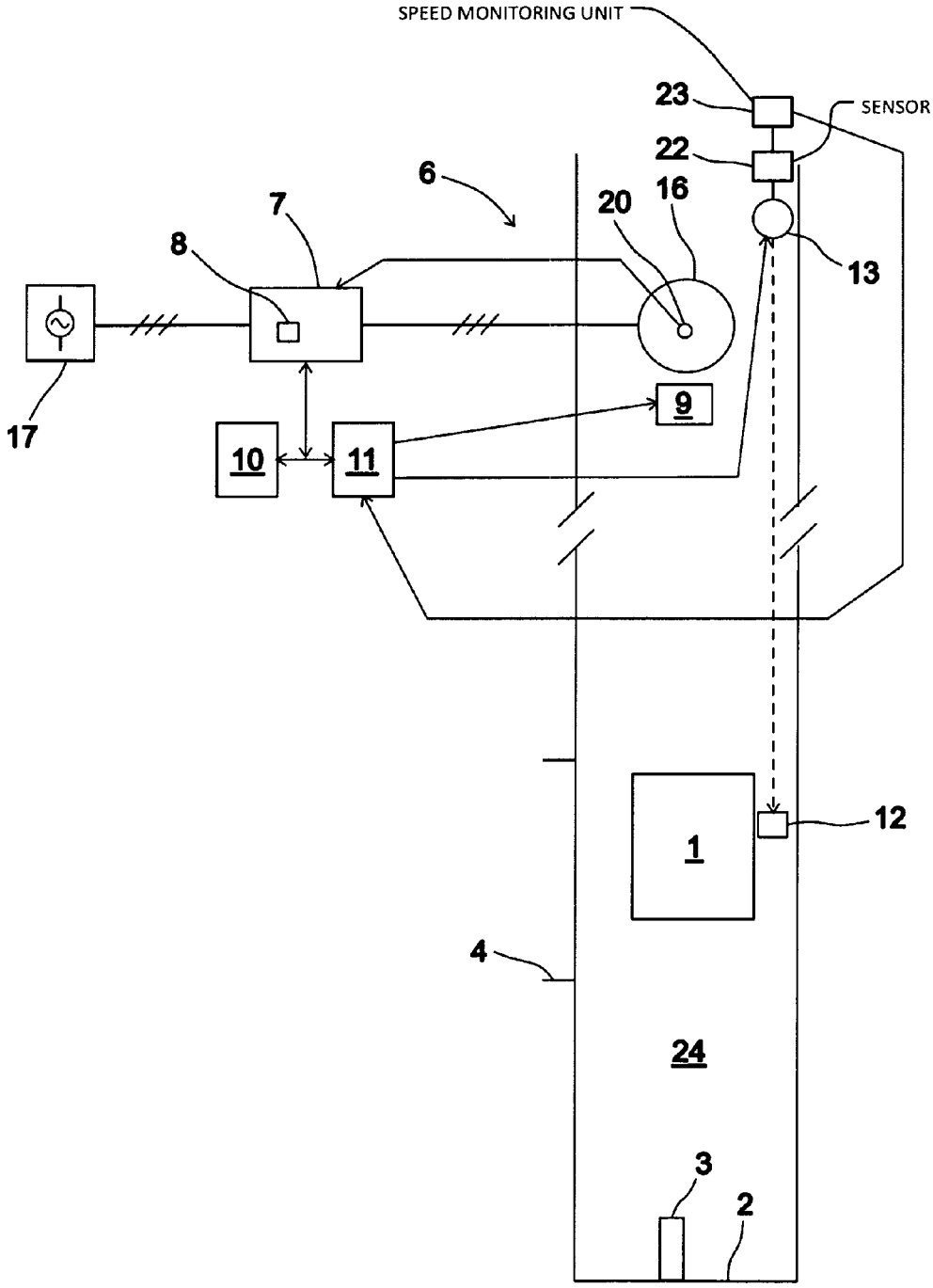
FIG. 2 presents as a block diagram an elevator system according to a second embodiment of the invention

FIG. 2 presents as a block diagram an elevator system according to a second embodiment of the invention, wherein the elevator car 1 is moved in the elevator hoistway 24 with an electric drive 6, which comprises the hoisting machine 16 of the elevator and also a frequency converter 7. The elevator car 1 and the counterweight 18 are suspended in the elevator hoistway 24 with hoisting ropes, a belt or corresponding (not shown in the figure) passing via the traction sheave of the hoisting machine 16 of the elevator. The power supply to the electric motor of the hoisting machine 16 of the elevator occurs with a frequency converter 7 from an electricity network 17. The control unit 10 of the elevator calculates the target value for speed, i.e. the speed reference, of the elevator car 1 to be moved in the elevator hoistway 24 and the frequency converter 7 adjusts the speed of the hoisting machine 16, and thereby indirectly also the speed of the elevator car 1, towards the aforementioned speed reference communicated to the frequency converter 7. For adjusting the speed the frequency converter measures the speed of rotation of the hoisting machine 16 of the elevator with a speed sensor, such as with a pulse encoder 20, a tachometer or corresponding, fitted to the shaft of the hoisting machine 16.

The elevator system also comprises a monitoring arrangement, which is usually made to be at least partly separate from the rest of the control system of the elevator. The task of the monitoring arrangement is to take care of the safety of the elevator system. The monitoring arrangement comprises, in addition to the safety circuit 11 of the elevator, inter alia, monitoring units 8, sensors 20, 22, and braking devices 9, 12. The braking devices, such as a machinery brake 9 and a safety gear 12, are connected to the safety circuit such that the machinery brake 9 and the safety gear 12 can be activated via the safety circuit. The monitoring arrangement measures the operating state of the elevator system and when it detects a hazardous situation performs one or more procedures for bringing the elevator system to a safe state. Such procedures are, inter alia, activation of emergency braking and also prevention of the starting of a run of the elevator car 1.

The sensors incorporated in the safety circuit 11 of the elevator system are e.g. the safety switches (not shown in the figure) monitoring the locking/state of entrances to the elevator hoistway 13, and also the limit switches (not shown in the figure) monitoring the limits of the areas of permitted movement of the elevator car 1 in the elevator hoistway 24. The speed of the elevator car is measured with sensors 20 that measure the speed of rotation of the hoisting machine 16. Additionally, in this embodiment of the invention the speed of the elevator car is measured directly with a sensor 22, which is arranged in connection with the rope pulley 13 of the overspeed governor, for measuring the speed of rotation of the rope pulley 13.

The monitoring arrangement also comprises a speed monitoring unit 23, which is connected to a sensor 22 arranged in connection with the rope pulley 13. The speed monitoring unit 23 is connected to the safety circuit of the elevator.

The monitoring arrangement measures the speed of the elevator car 1 and compares the measured speed to the limit values for permitted maximum speed. When the speed of the elevator car 1 exceeds the limit value for permitted speed, the monitoring arrangement activates consecutive emergency braking procedures such that the deceleration of the elevator car increases progressively. FIG. 3 illustrates in more detail some limit values $v_{lim1}$, $v_{lim2}$, $v_{lim3}$ for permitted speed according to the embodiment of FIG. 2, described in relation to the position 15 of the elevator car. Each of the limit values $v_{lim1}$, $v_{lim2}$, $v_{lim3}$ for permitted speed of the elevator car depends upon the position 15 of the elevator car on its path of movement such that the limit value $v_{lim1}$, $v_{lim2}$ for permitted speed, to which the speed v of the elevator car 1 is compared, decreases when the position 15 of the elevator car 1 towards the end 2 of the elevator hoistway changes. The control unit 8 of an emergency stop fitted in connection with the frequency converter 7 compares the speed v of the elevator car 1 measured with the encoder 20 of the hoisting machine of the elevator to the first limit value $v_{lim1}$ for permitted speed. If the speed v of the elevator car 1 exceeds the first limit value $v_{lim1}$ for permitted speed, the control unit 8 of an emergency stop activates a first emergency braking procedure. As a first emergency stop procedure the control unit 8 of an emergency stop controls the electric drive 6, adjusting the speed v of the elevator car towards the target value 5 for speed during an emergency stop. The control unit 8 of an emergency stop also calculates the aforementioned target value 5 for speed during an emergency stop such that the target value 5 for speed during an emergency stop is formed independently from the speed reference during normal operation of the elevator calculated by the control unit 10 of the elevator.

The aforementioned first limit value $v_{lim1}$ for permitted speed of an elevator car is determined such that the elevator car can be stopped at a first deceleration $a_1$ at the terminal floor 4, or in the immediate proximity of the terminal floor 4, from the speed v that the elevator car has at the moment of activating the first emergency stop procedure. The first limit value $v_{lim1}$ for permitted speed is determined by means of the first deceleration $a_1$ of the elevator car and also the distance of the elevator car from the terminal floor s from the equation:

$$v_{lim1}=\sqrt{2a_1(s+\Delta s)}.$$

In addition, the first limit value $v_{lim1}$ for permitted speed in the equation above is increased by adding the term $\Delta s$ to the distance of the elevator car from the terminal floor s. This ensures that the first emergency braking procedure is not activated in the proximity of the stopping floor of the elevator owing to a fluctuation in the instantaneous speed of the elevator car.

The sensor 22 presented above that is arranged in connection with the rope pulley 13 of the overspeed governor measures the speed v of the elevator car 1. The speed monitoring unit 23 connected in connection with the sensor 22 compares the speed data measured by the sensor 22 also to the second limit value $v_{lim2}$ for permitted speed of the elevator car. If the speed v of the elevator car 1 still increases, exceeding the second limit value $v_{lim2}$ for permitted speed that is larger than the aforementioned first limit value $v_{lim1}$ for permitted speed, the speed monitoring unit 23 activates, as a second emergency braking procedure, the machinery brake 9.

The speed monitoring unit 23 connected in connection with the sensor 22 determines the aforementioned second limit value $v_{lim2}$ for permitted speed of the elevator car such that the speed of the elevator car can be slowed down before collision with the end buffer 3 at a second deceleration $a_2$ determined by the machinery brake 9 to the permitted buffer collision speed $v_{coll}$ from the speed v that the elevator car has at the moment of activating the second emergency braking procedure. The second limit value $v_{lim2}$ for permitted speed is determined by means of the second deceleration $a_2$ of the elevator car, the distance of the elevator car from the end buffer d and also the permitted buffer collision speed $v_{coll}$, from the equation:

$$v_{lim\,2}=\sqrt{2a_2d+v_{\mathrm{coll}}^2}-\Delta v_{safety}.$$

In addition, the second limit value $v_{lim2}$ for speed in the equation above is reduced for safety reasons with the term $\Delta v_{safety}$. This ensures an adequate braking distance irrespective of a possible instantaneous fluctuation in the deceleration of the elevator car and also irrespective of e.g. an activation delay of the machinery brake.

The speed monitoring unit 23 connected in connection with the sensor 22 compares the speed data measured by the sensor 22 also to the third limit value $v_{lim3}$ for permitted speed of the elevator car. If the speed v of the elevator car 1 still increases, exceeding the third limit value $v_{lim3}$ for permitted speed that is larger than the aforementioned second limit value $v_{lim2}$ for permitted speed, the speed monitoring unit 23 activates, as a third emergency braking procedure, the safety gear 12 of the elevator car by stopping the rotation of the rope pulley 13 of the overspeed governor, and thus the movement of the rope of the overspeed governor, by controlling a solenoid into the path of movement of the rope pulley 13 of the overspeed governor.

The speed monitoring unit 23 connected in connection with the sensor 22 determines the aforementioned third limit value $v_{lim3}$ for permitted speed of the elevator car such that the speed of the elevator car 1 can be slowed down before collision with the end buffer 3 at a third deceleration $a_3$ determined by the safety gear 12 of the elevator car to the permitted buffer collision speed $v_{coll}$ from the speed v that the elevator car has at the moment of activating the third emergency braking procedure. The third limit value $v_{lim3}$ for permitted speed is determined by means of the third deceleration $a_3$ of the elevator car, the distance of the elevator car from the end buffer d and also the permitted buffer collision speed $v_{coll}$, from the equation:

$$v_{lim\,3}=\sqrt{2a_3d+v_{\mathrm{coll}}^2}+\Delta v_{safety}.$$

In addition, the third limit value $v_{lim3}$ for speed in the equation above is further reduced for safety reasons with the term $\Delta v_{safety}$. This ensures an adequate braking distance irrespective of a possible instantaneous fluctuation in the deceleration of the elevator car and also irrespective of e.g. an activation delay of the safety gear of the elevator car.

The magnitude of the progressive increase in deceleration in connection with the first and the second emergency braking procedure is in the first and second embodiment of the invention set at ten percent of the normal deceleration of the elevator, in which case e.g. when the normal deceleration determined by the speed reference of the elevator is 1 m/s^2 the first deceleration according to the first emergency braking procedure is approx. 1.1 m/s^2 and the second deceleration according to the second emergency braking procedure is approx. 1.2 m/s^2.

Figure 4:
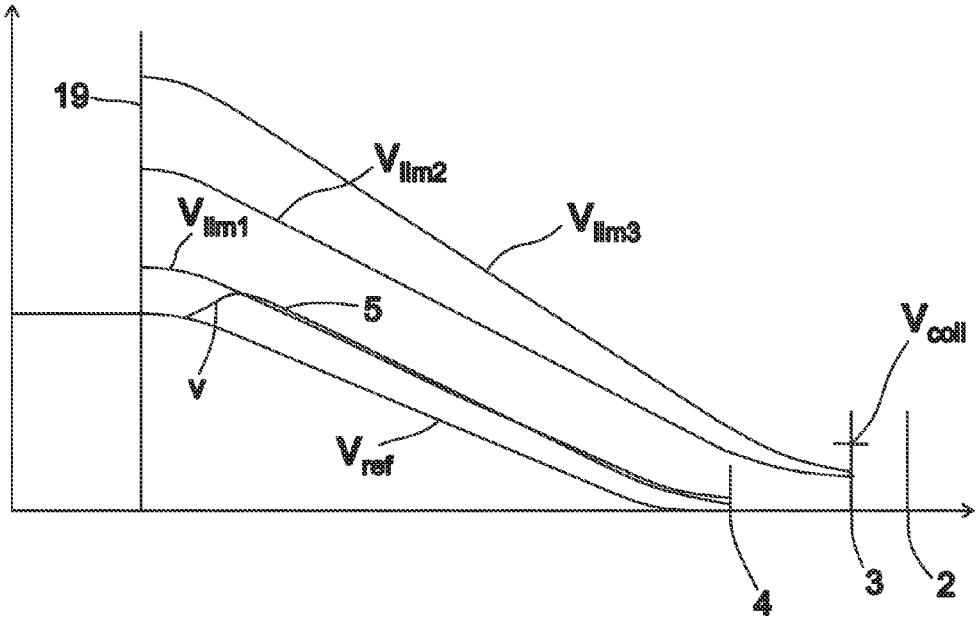
FIG. 4 illustrates the speed reference of an elevator, the limit values for permitted speed of an elevator car, and also the measured speed of an elevator car during the deceleration phase of a run of the elevator car

For illustrative purposes and relating to the embodiments of the invention that are described above, FIG. 4 further presents the speed reference $v_{ref}$ of an elevator, the starting moment 19 of the deceleration phase of an elevator car, the target value 5 for speed during an emergency stop, the limit values $v_{lim1}$, $v_{lim2}$, $v_{lim3}$ for permitted speed of an elevator car, and also the measured speed v of an elevator car as a function of time in the deceleration phase of a run of an elevator car.

In the preceding embodiments of the invention, the monitoring of the movement of an elevator car in the bottom part of an elevator hoistway is described. The invention can, however, be used for monitoring the movement of an elevator car also in the top part of an elevator hoistway in a corresponding manner, taking into account the effect on the second and third deceleration of the elevator car possibly caused by a change in the direction of movement of the masses of the elevator. Likewise the invention can be applied to monitoring the movement of a counterweight, instead of or in addition to the movement of an elevator car.

The elevator system according to the invention can be provided with a counterweight or can be one without a counterweight.

The invention is described above by the aid of a few examples of its embodiment. It is obvious to the person skilled in the art that the invention is not limited only to the embodiments described above, but that many other applications are possible within the scope of the inventive concept defined by the claims.

The invention claimed is:

1. A method for monitoring movement of an elevator car of an elevator, the method comprising:

activating a first emergency braking procedure to brake the elevator car at a first deceleration if the speed of the elevator car exceeds a first limit value for permitted speed; and activating a second emergency braking procedure to brake the elevator car at a second deceleration if the speed of the elevator car exceeds a second limit value for permitted speed, the second deceleration being greater than the first deceleration, and the second limit value being greater than the first limit value;

wherein at least one of the first limit value for permitted speed is calculated based on the first deceleration, and the second limit value for permitted speed is calculated based on the second deceleration.

2. The method according to claim 1, wherein the first deceleration of the elevator car is greater than a reference deceleration of the elevator car according to a deceleration phase of the speed reference.

3. A method for monitoring movement of an elevator car of an elevator, the method comprising:

activating a first emergency braking procedure to brake the elevator car at a first deceleration if the speed of the elevator car exceeds a first limit value for permitted speed; and activating a second emergency braking procedure to brake the elevator car at a second deceleration if the speed of the elevator car exceeds a second limit value for permitted speed, the second deceleration being greater than the first deceleration, and the second limit value being greater than the first limit value; and activating a third emergency braking procedure to brake the elevator car at a third deceleration if the speed of the elevator car exceeds a third limit value for permitted speed, the third deceleration being greater than the second deceleration, and the third limit value being greater than the second limit value for permitted speed.

4. The method according to claim 3, wherein each of the first, second and third limit values are based on a position of the elevator car on a path of movement within an elevator hoistway such that the first, second and third limit values decrease as the elevator car approaches the end of the elevator hoistway.

5. The method according to claim 4, wherein the first limit value decreases by a first gradient, the first gradient being dependent on the first deceleration of the elevator car.

6. The method according to claim 5, wherein the second limit value decreases by a second gradient, the second gradient being dependent on the second deceleration of the elevator car.

7. The method according to claim 6, wherein the third limit value decreases by a third gradient, the third gradient being dependent on the third deceleration of the elevator car.

8. The method according to claim 1, wherein the activating the first emergency braking procedure comprises:

adjusting the speed of the elevator car towards a target value for speed during an emergency stop by controlling an electric drive of the elevator with a control unit of the emergency stop.

9. The method according to claim 1, wherein the activating of the second emergency braking procedure comprises:

activating one or more machinery brakes of a hoisting machine of the elevator.

10. The method according to claim 3, wherein the activating of the third emergency braking procedure comprises:

activating a safety gear of the elevator car.

11. An elevator system comprising:

an electric drive configured to move an elevator car in an elevator hoistway;

a machinery brake;

a monitoring arrangement including a controller that controls the electric drive and the machinery brake, the monitoring arrangement activating a first emergency braking procedure to brake the elevator car at a first deceleration if the speed of the elevator car exceeds a first limit value for permitted speed, and activating a second emergency braking procedure to brake the elevator car at a second deceleration if the speed of the elevator car exceeds a second limit value for permitted speed, the second deceleration being greater than the first deceleration, and the second limit value being greater than the first limit value for permitted speed;

wherein at least one of, the first limit value for permitted speed is calculated based on the first deceleration, and the second limit value for permitted speed is calculated based on the second deceleration.

12. The elevator system according to claim 11, wherein the first deceleration is greater than a reference deceleration of the elevator car according to a deceleration phase of the speed reference.

13. The elevator system according to claim 11, wherein the monitoring arrangement includes a control unit for an emergency stop, and the control unit adjusts the speed of the elevator car towards a target value for speed during the emergency stop.

14. The elevator system according to claim 11, wherein the monitoring arrangement activates the machinery brake to brake the elevator car at the second deceleration.

15. An elevator system comprising:

an electric drive configured to move an elevator car in an elevator hoistway;

a machinery brake;

a monitoring arrangement including a controller that controls the electric drive and the machinery brake, the monitoring arrangement activating a first emergency braking procedure to brake the elevator car at a first deceleration if the speed of the elevator car exceeds a first limit value for permitted speed, and activating a second emergency braking procedure to brake the elevator car at a second deceleration if the speed of the elevator car exceeds a second limit value for permitted speed, the second deceleration being greater than the first deceleration, and the second limit value being greater than the first limit value for permitted speed; wherein the elevator system includes a safety gear, the monitoring arrangement includes a controller for the safety gear, and the monitoring arrangement, as a third emergency braking procedure, activates the safety gear for braking the elevator car at a third deceleration if the speed of the elevator car exceeds a third limit value for permitted speed, the third deceleration being greater than the second deceleration, and the third limit value being greater than the second limit value.

16. The elevator system according to claim 15, wherein each of the first, second and third limit values are dependent on a position of the elevator car on a path of movement within the elevator hoistway such that the first, second and third limit values decrease as the elevator car approaches the end of the elevator hoistway.

17. The elevator system according to claim 16, wherein the first limit value is reduced by a first gradient, the first gradient being dependent on the first deceleration of the elevator car.

18. The elevator system according to claim 17, wherein the second limit value is reduced by a second gradient, the second gradient being dependent on the second deceleration of the elevator car.

19. The method according to claim 18, wherein the third limit value is reduced by a third gradient, the third gradient depending on the third deceleration of the elevator car.

* * * * *